US006141430A

United States Patent [19]

Imahori et al.

[11] Patent Number: 6,141,430

[45] Date of Patent: Oct. 31, 2000

[54] ELECTROACOUSTIC TRANSDUCER

[75] Inventors: Yoshio Imahori; Isao Fushimi, both of Shizuoka, Japan

[73] Assignee: Star Micronics Co., Ltd., Shizuoka, Japan

[21] Appl. No.: 09/060,163

[22] Filed: Apr. 15, 1998

[30] Foreign Application Priority Data

Apr. 15, 1997 [JP] Japan ..... 9-114322

[51] Int. Cl.[7] ..... H04R 25/00

[52] U.S. Cl. ..... 381/417; 381/426; 381/431

[58] Field of Search ..... 381/176, 412, 381/417, 423, 426, 396, 398, 427, 428, 431, FOR 160; 181/167, 168, 169, 170

[56] References Cited

U.S. PATENT DOCUMENTS 2,496,483 2/1950 Massa ..... 381/426
3,497,642 2/1970 Pintell ..... 381/426
3,542,974 11/1970 Blastic et al. ..... 381/417
5,416,751 5/1995 Imahori et al. ..... 367/175

FOREIGN PATENT DOCUMENTS 6-165293 6/1994 Japan ..... H04R 13/00
2096862 10/1982 United Kingdom ..... 381/FOR 160

OTHER PUBLICATIONS

Webster's Ninth New Collegiate Dictionary, p. 103, 1983.

*Primary Examiner*—Huyen Le
*Attorney, Agent, or Firm*—Sughrue, Mion, Zinn, Macpeak & Seas, PLLC

[57] ABSTRACT

An electroacoustic transducer, which has a diaphragm, a support member for supporting the diaphragm, a pole piece placed inside the support member and comprising a core and a base, a coil wound around the core, and a magnet placed between the support member and the coil, in which the diaphragm is made of resin to which a magnetization is applied.

14 Claims, 7 Drawing Sheets

ELECTROACOUSTIC TRANSDUCER

BACKGROUND OF THE INVENTION

1. Field of the Invention

The present invention relates to an electroacoustic transducer, and more particularly, to an electroacoustic transducer in which a diaphragm is made of resin so that the diaphragm may become thin, light-weight, complicated in shape and flexible, in order to improve the vibration efficiency.

2. Description of the Related Art

A structure of an electroacoustic transducer as an example of the prior art is illustrated in FIGS. 13 and 14. There is an upper case 201, and formed at the center of the FIG. 13 is a sound port 203. There is also a lower case 205 under the upper case 201 in FIG. 13, and the lower case 205 and the upper case 201 are welded and fixed by ultrasonic welding. There is an opening 207 formed at the bottom of the lower case 205 in FIG. 13. A base 209 and a core 211 are integrally (namely, the separate parts have been integrated in advance) secured to the opening 207 as a "pole piece" 212. A board 213 is also attached on the bottom surface of the base 209 in FIG. 13.

A coil 215 is wound around the core 211. Coil terminals 215*a* and 215*b* of the coil 215 are respectively secured, for example by means of solder welding, to lead terminals 217 and 219 attached to the board 213. A magnet 223 is placed around the coil 215 with an existence of a ring-like clearance 221 formed in between. The aforementioned lower case 205 is provided, at the inner periphery thereof, with a step portion 225 at which a diaphragm 227 is supported. The diaphragm 227 comprises an elastic plate 228, and a magnetic piece 229 which is attached as an added mass to the center portion of the elastic plate 228. The magnetic piece 229 is welded and fixed, for example by means of spot welding, to the elastic plate 228.

In the thus constituted electroacoustic transducer, the elastic plate 228 integrally provided with the magnetic piece 229, is set to have a given polarity by means of the magnet 223, and hence, is attracted to the magnet 223. When a current flows across the coil 215 via the lead terminals 217 and 219 under this situation, the core 211 is magnetized, generating a magnetic field at the distal end thereof. When the magnetic pole of the core 211 induced by the coil 215 is different from the magnetic pole induced by the magnet 223 attached to the elastic plate 228, the elastic plate 228 is attracted to the core 211. When the magnetic pole of the core 211 induced by the coil 215 is the same as the magnetic pole induced by the magnet 223 attached to the elastic plate 228, the elastic plate 228 repels the core 211.

Consequently, by allowing the current to intermittently flow in either direction, the elastic plate 228 repeats the above-discussed operation. In other words, the elastic plate 228 vibrates at a given frequency, thus generating a sound.

In regard to the electroacoustic transducer having the above discussed structure and function, each constituent part thereof is classified into "structural section", "magnetic circuit section", "electromagnetic coil section" and "acoustic circuit section" according to the function.

In detail, the structural section includes the lower case 205, the base 209, the elastic plate 228 and the core 211.

Similarly, the magnetic circuit section includes the base 209, the elastic plate 228, the core 211 and the magnet 223.

The electromagnetic coil section includes the coil 215, the lead terminals 217 and 219, and the board 213.

For reference, the identical part may be included in different sections at the same time.

With regard to the constituent parts which belong to the magnetic circuit section, the magnetic flux from the magnet 223 as well as the magnetic flux by magnetomotive force from the coil 215 are required to effectively be induced in the magnetic circuit. Thus the constituent parts included in the magnetic circuit section, namely, the base 209, the elastic plate 228, the core 211 and the magnet 223, are made of material having high magnetic permeability, like metal such as steel or nickel.

Further, as fox the constituent parts which belong to the structural section, the following conditions are required. Firstly, with regard to the elastic plate 228, the efficient vibration by means of magnetic force between the magnetic circuit section and the electromagnetic coil section is required, hence the elastic plate 228 is required to have remarkable flexibility as well as rigidity. Secondly, with regard to the other constituent parts in the structural section, a gap between the elastic plate 228 and the core 211 (as shown by letter L in FIG. 13) is required to be extremely precise, as well as to prohibit variation of length of gap L due to environmental change such as temperature. Therefore the constituent parts in this section may preferably be made of high-workability engineering plastic material, such as polyphenylene oxide (PPE), nylon, liquid crystal polymer (LCP), etc.

However, as above discussed, the base 209, the elastic plate 228, and the core 211 in the structural section also belong to the magnetic circuit section, and because of functional priority to be given to the parts of the magnetic section, the high magnetic-permeability material such as steel or nickel (i.e. metal) is ordinarily used for these parts.

As for the lower case 205, which is in the structural section but in the magnetic circuit section, the engineering plastic material such as PPE, nylon, LCP is used.

The above discussed prior art has the following problem.

As above discussed, in the case of the electroacoustic transducer in the prior art, the elastic plate 228 is made of metal, hence there is a limit of improvement of the vibration efficiency. In order to increase the sound pressure, as well as to expand the frequency band to be able to obtain the predetermined sound pressure, the improvement of vibration efficiency is required. For that purpose, the elastic plate 228 should be thinner, lighter and more complicated in shape, namely, the elastic plate 228 should be more flexible and should integrally be formed with the magnetic piece 229. However, as long as the elastic plate 228 is made of metal, there are problems as seen from workability (for example, strain due to working), hence the elastic plate 228 cannot become thin, light-weight, complicated shape and flexible. Therefore it has been difficult to improve the vibration efficiency.

Further, in regard to the constituent parts of the structural section, only the lower case 205 is made of engineering plastic material such as PPE, nylon or LCP, and the other parts are made of metal. Accordingly, there is another problem that the length of the gap L in FIG. 13 varies due to change in temperature since the thermal expansion rate of each part is different.

SUMMARY OF THE INVENTION

It is an object of the present invention to provide an electroacoustic transducer, in which a vibration efficiency may improve, and which can prohibit a variation of gap length between an elastic plate serving as a diaphragm and a top of a pole piece.

To achieve the object mentioned above, according to the present invention, there is provided an electroacoustic transducer, which has a diaphragm, a support member for supporting the diaphragm, a pole piece located inside the support member and comprising a core and a base, a coil wound around the core, and a magnet located between the support member and the coil, in which the diaphragm is made of resin to which a magnetization is applied.

Preferably, the diaphragm may be in a shape to enlarge a gross area of application of the magnetization without changing thickness of the diaphragm. For example, the diaphragm may have uneven surfaces.

For this purpose, the diaphragm may have at least one ring groove.

Preferably, the magnetization may be partially and selectively applied to the diaphragm.

Preferably, the support member may be made of resin, and the pole piece may be made of resin to which the magnetization is applied.

Preferably, the resin may be an engineering plastic material.

Preferably, the magnetization may be accomplished by plating, adhesion of laminated foils, coating of paste of magnetic material, or mixing of magnetic powder, and the magnetic material used for the magnetization may be Ni—Fe alloy, of which ratio may correspond to 75%–25%.

With this structure, the diaphragm is made of resin to which the magnetization is applied. Therefore, the workability may improve, and the diaphragm may become thin, light-weight, complicated in shape and flexible, thereby the vibration efficiency may improve, namely, the higher sound pressure and the wider frequency band which can obtain the predetermined sound pressure, can be accomplished.

Further, when the diaphragm has a shape to enlarge a gross area of application of the magnetization without changing thickness of the diaphragm, the area of the magnetic path is also enlarged, thereby the efficiency of magnetic force may improve, thus the higher sound pressure and the improved (wider) frequency band can be obtained.

Further, since the equivalent efficiency of magnetic force may be obtained by a thinner application of a layer of the magnetic material, the diaphragm may become thinner and lighter, thereby the higher sound pressure and the improved (wider) frequency band can also be obtained.

Further, the adjustment of sound pressure and frequency band through the adjustment of vibration efficiency can be carried out by partial and selective magnetization of the diaphragm.

Further, when both the support member and the pole piece are made of resin, the common material is used for the support member to support the diaphragm and the pole piece, thereby the amounts of thermal distortion due to environmental change become equal to each other, thus the variation of length of the gap between the diaphragm and the top of the pole piece can be prohibited.

BRIEF DESCRIPTION OF THE DRAWINGS

The invention will be described below in detail with reference to the accompanying drawings, in which.

DETAILED DESCRIPTION OF THE INVENTION

(First Embodiment)

Figure 1:
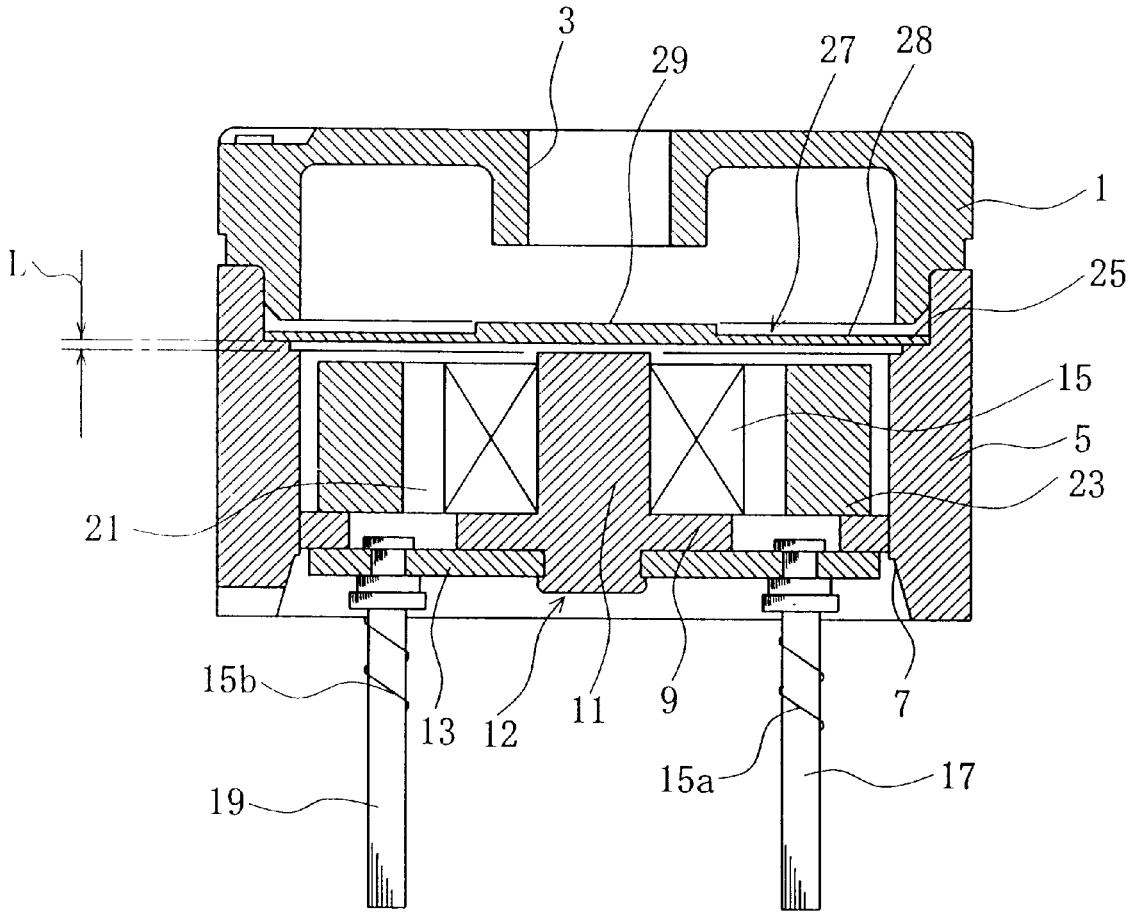
FIG. 1 is a sectional view showing an overall structure of an electroacoustic transducer according to a first embodiment of the present invention.

A first embodiment of the present invention will now be described with reference to FIGS. 1 through 5. As illustrated in FIG. 1, there is an upper case 1, and a sound port 3 is formed at the center of the upper case 1. The upper case 1 and a lower case 5 positioned under the upper case 1 are welded and fixed by ultrasonic welding. The lower case 5 has an opening 7 at the bottom thereof in FIG. 1. A base 9 and a core 11 have been formed integrally to serve as a "pole piece" 12, and a board 13 is attached on the bottom surface of the base 9.

A coil 15 is wound around the core 11. Coil terminals 15*a* and 15*b* of the coil 15 are respectively secured, by means of solder welding, for example, to lead terminals 17 and 19 attached to the board 13. A magnet 23 is placed around the coil 15 with an existence of a ring-like clearance 21 formed in between. The aforementioned lower case 5 is provided, at the inner periphery thereof, with a step portion 25 at which a diaphragm 27 is supported. The diaphragm 27 comprises a flat plate member (an elastic plate) 28, and an added mass member 29 integrally formed at the center portion of the flat plate member 28.

Figure 2:
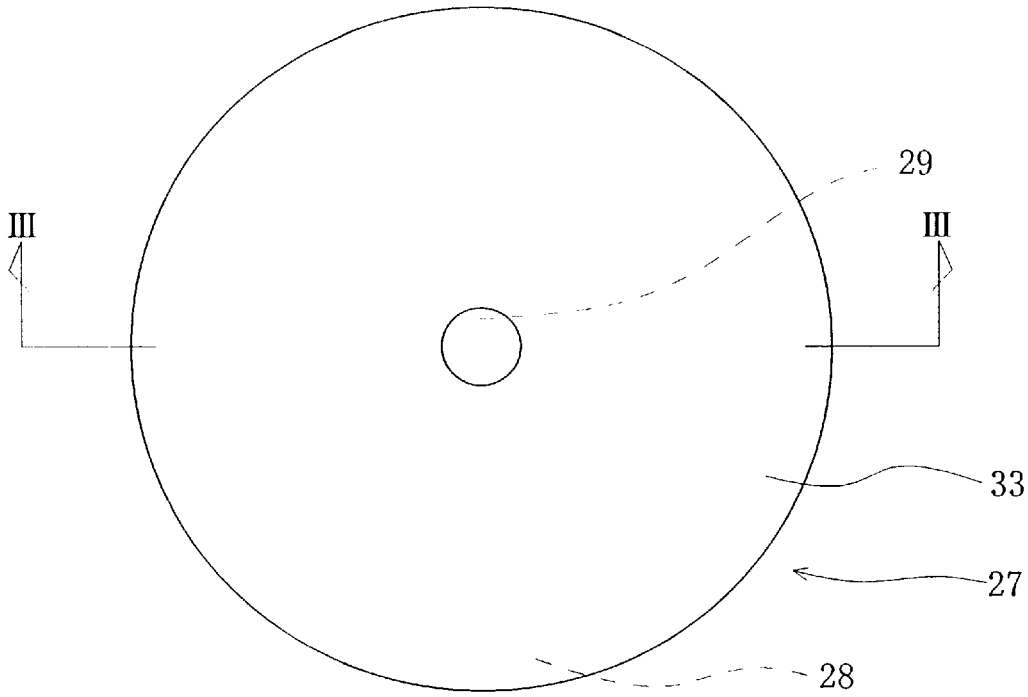
FIG. 2 is a plan view of a diaphragm according to the first embodiment of the present invention.
Figure 3:
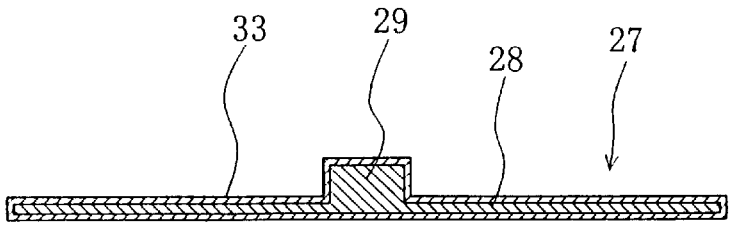
FIG. 3 is a cross-sectional view of the first embodiment taken along the line III—III in FIG. 2.

The structure of the diaphragm 27 will now be described in detail with reference to FIGS. 2 and 3. In the present embodiment, as above discussed, the flat plate member 28 and the added mass member 29 are integrally formed to serve as the diaphragm 27. The diaphragm 27 may be made of engineering plastic material such as polyphenylene oxide (PPE), nylon, liquid crystal polymer (LCP), etc. A magnetic material 33 is applied to the outer surface of the flat plate member 28 and the added mass member 29.

The method of application of the magnetic material 33 thereto is not limited to plating. For example, an adhesion of laminated foils, or a coating of paste of magnetic material, may be utilized. Further, there may be a mixture of magnetic powder and the engineering plastic material such as PPE, nylon, LCP, without providing a layer of the magnetic material 33.

For example, the magnetic material 33 is made of Ni—Fe alloy, of which preferable ratio may correspond to 75%–25%. In order to perform the necessary function as a magnetic circuit, the thickness of application should substantially be equivalent to the thickness of the flat plate member 28 (in particular, several tens of $\mu$m).

It is clear that the above is an example of the present embodiment, thus the substance and thickness of the magnetic material 33 may be decided mutatis mutandis.

In addition, although the diaphragm 27 is made only of resin in the present embodiment, it is of course clear that any proper mixture of metal and resin can be utilized for making the diaphragm 27, taking account of the characteristic of each material, namely metal and resin. If the mixture of metal and resin is properly prepared, the adjustment of acoustic characteristics, for example the sound pressure or frequency band, can freely be made.

Figure 4:
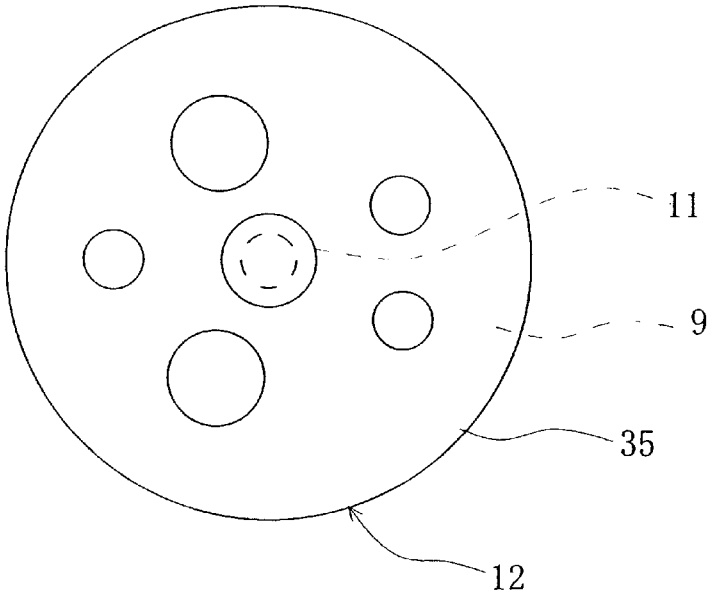
FIG. 4 is a plan view of a pole piece according to the first embodiment of the present invention.
Figure 5:
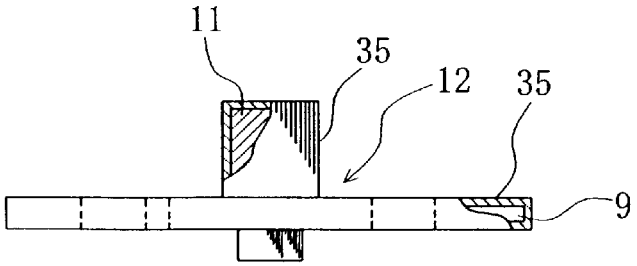
FIG. 5 is an elevational view of the pole piece with a part thereof cut away according to the first embodiment of the present invention.

The structure of the pole piece 12 will now be described in detail with reference to FIGS. 4 and 5. Like the case of the above mentioned diaphragm 27, the base 9 and the core 11 are integrated to serve as the pole piece 12, of which material is the engineering plastic material such as PPE, nylon and LCP. The outer surface of the pole piece 12 comprising the base 9 and the core 11 is provided with a layer of a magnetic material 35. The ingredient of the magnetic material 35 is the same as the case of the diaphragm 27.

Since the function of the present embodiment as the electroacoustic transducer is the same as that of the prior art, the explanation thereof will not be made.

The present embodiment has the following merits.

Firstly, in the present embodiment, since the diaphragm 27 is made of engineering plastic material such as PPE, nylon, LCP, it is possible to improve the vibration efficiency of the diaphragm 27 itself. Apart from any diaphragm in prior art made of metal, the diaphragm 27 in the present embodiment is made of engineering plastic material (PPE, nylon, LCP, etc.), thus the workability improves (namely, little occurrence of strain due to working), thereby the diaphragm 27 in the present embodiment can be made to be thin, complicated in shape and flexible. This is because, if the diaphragm 27 is the same thickness as (or even thicker to some extent than) the other diaphragm made of metal, the engineering plastic material will have characteristics such as higher flexibility and lighter weight than metal. In addition, the engineering plastic material also has a higher efficiency of magnetic force than metal, because the layer of magnetic material 33 applied by plating, etc. has no strain due to working. Therefore, the equivalent efficiency of magnetic force may be obtained by thinner application to the engineering plastic material than that to metal.

Secondly, in the present embodiment, the pole piece 12 is integrally made of the same material as that of the diaphragm 27, namely engineering plastic material such as PPE, nylon, LCP, etc. The engineering plastic material such as PPE, nylon, LCP, etc. is also used for the lower case 5, of which art is known per se. In the thus described structure, it is possible to prohibit the variation of length of a gap (as shown by letter L in FIG. 1) due to environmental change such as temperature. Namely, since the lower case 5 and the pole piece 12 are both made of engineering plastic material such as PPE, nylon, LCP, the amounts of thermal distortion thereof (especially in the axial direction) due to change in temperature become equal to each other, thereby the constant length of gap L (in FIG. 1) may be maintained.

Thirdly, since both the diaphragm 27 and pole piece 12 are integrally formed, the number of parts may be reduced, thereby facilitating quality control. Further, as the diaphragm 27, the pole piece 12 and the lower case 5 are all made of the common material, the parts material can be unified, which facilitates the process of manufacture.

(Second Embodiment)

A second embodiment of the present invention will be described with reference to FIGS. 6 and 7. In the first embodiment as above discussed, the flat plate member 28 of the diaphragm 27 is in a flat shape. However, according to the first embodiment, the flat plate member 28 has a plurality of (in the present embodiment, three) coaxial ring grooves 31.

Figure 6:
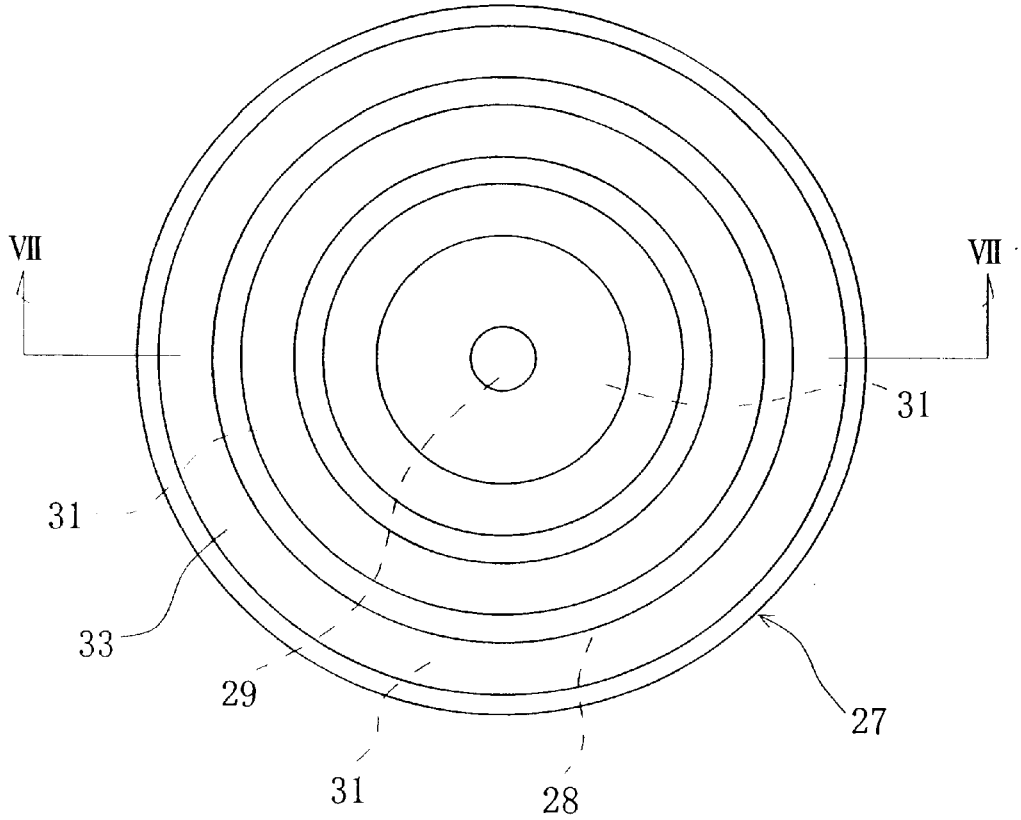
FIG. 6 is a plan view of a diaphragm according to a second embodiment of the present invention.
Figure 7:
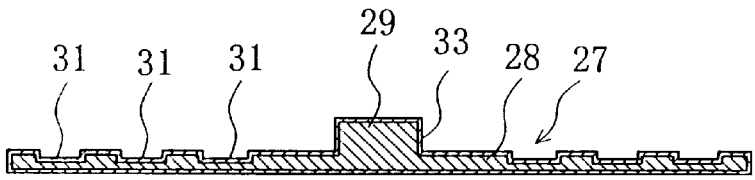
FIG. 7 is a cross-sectional view of the second embodiment taken along the line VII—VII in FIG. 6.

As shown in FIGS. 6 and 7 in the present embodiment, since the plurality of ring grooves 31 are provided on the flat plate member 28 of the diaphragm 27, the gross area of application of the layer of the magnetic material 33 is enlarged, thus the area of the magnetic path is also enlarged, thereby the efficiency of magnetic force may improve. In addition, the equivalent efficiency of magnetic force may be obtained by thinner application of the layer of the magnetic material 33.

(Third Embodiment)

Figure 8:
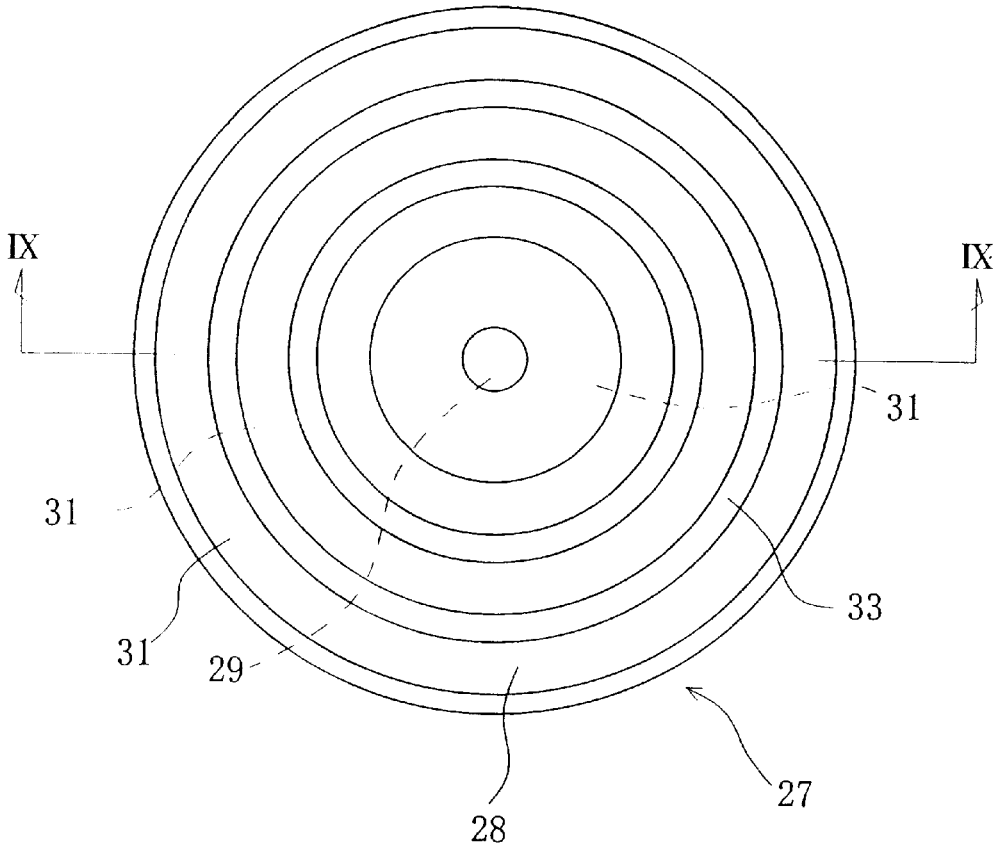
FIG. 8 is a plan view of a diaphragm according to a third embodiment of the present invention.
Figure 9:
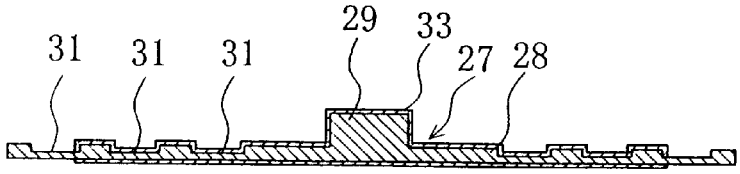
FIG. 9 is a cross-sectional view of the third embodiment taken along the line IX—IX in FIG. 8.

A third embodiment of the present invention will be described with reference to FIGS. 8 and 9. In the second embodiment as above discussed, the layer of the magnetic material 33 is thoroughly provided on the outer surface of the flat plate member 28 of the diaphragm 27. However, according to the third embodiment, the layer of the magnetic material 33 is partially provided on the flat plate member 28. In particular, a predetermined ring-like portion of the flat plate member 28 close to circumference thereof (in the present embodiment, the outermost ring groove 31 and the outer portion thereof in FIGS. 8 and 9) is exposed without application of the magnetic material 33 thereto.

According to the third embodiment, it is also possible to obtain the same effect as that of the present invention. In particular, since the plurality of ring grooves 31 are provided on the flat plate member 28, the gross area of application of the layer of the magnetic material 33 is enlarged, thus the area of the magnetic path is also enlarged, thereby the efficiency of magnetic force may improve. Therefore the sufficient efficiency of magnetic force may be obtained by partial application of the layer of the magnetic material 33 in which the flat plate member 28 is partially exposed.

In addition, according to the third embodiment, the portion to be magnetized can be partially or selectively provided, thereby the vibration efficiency can be adjusted. Thus the sound pressure and frequency band can also be adjusted.

The partial application (for example, plating) of the magnetic material 33 is carried out by masking. The masking can be made by means of mechanical or optical method, etc.

(Fourth Embodiment)

Figure 10:
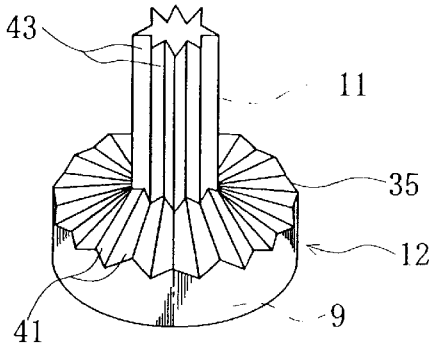
FIG. 10 is a perspective view showing a structure of a pole piece according to a fourth embodiment of the present invention.

A fourth embodiment of the present invention will be described with reference to FIG. 10. In the fourth embodiment, there is provided a different shape of the pole piece 12. Namely, there is an uneven portion 41 on the upper surface of the base 9, and also an uneven portion 43 on the cylindrical surface of the core 11. Accordingly, the gross area of application of the layer of the magnetic material 35 is enlarged, thus the area of the magnetic path is also enlarged, thereby the efficiency of magnetic force may improve. In addition, the equivalent efficiency of magnetic force may be obtained by thinner application of the layer of the magnetic material 35.

(Fifth Embodiment)

Figure 11:
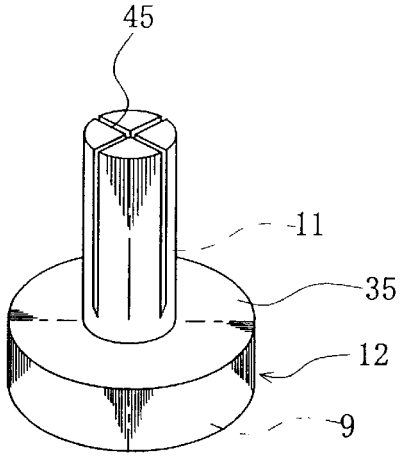
FIG. 11 is a perspective view showing a structure of a pole piece according to a fifth embodiment of the present invention.

A fifth embodiment of the present invention will be described with reference to FIG. 11. In the fifth embodiment, there is provided another shape of the pole piece 12. Namely, there are cross-shaped cutting grooves 43 in the core 11. Accordingly, the gross area of application of the layer of the magnetic material 35 is enlarged, thus the area of the magnetic path is also enlarged, thereby the efficiency of magnetic force may improve, and the equivalent efficiency of magnetic force may be obtained by thinner application of the layer of the magnetic material 35.

(Sixth Embodiment)

Figure 12:
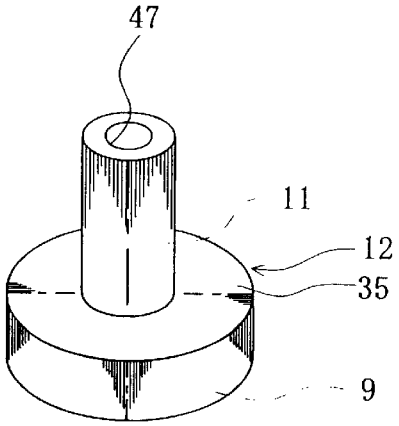
FIG. 12 is a perspective view showing a structure of a pole piece according to a sixth embodiment of the present invention.
Figure 13:
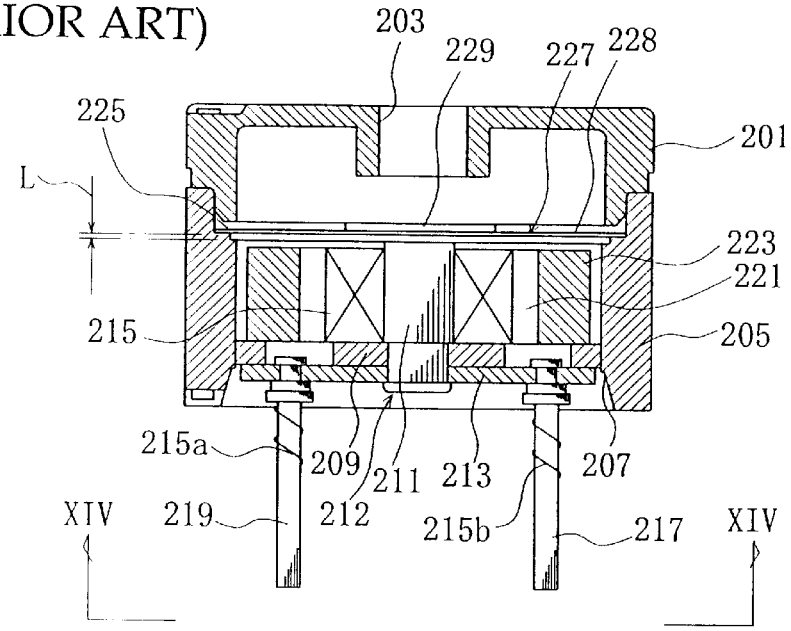
FIG. 13 (PRIOR ART)
FIG. 13 is a sectional view of an electroacoustic transducer according to a prior art.
Figure 14:
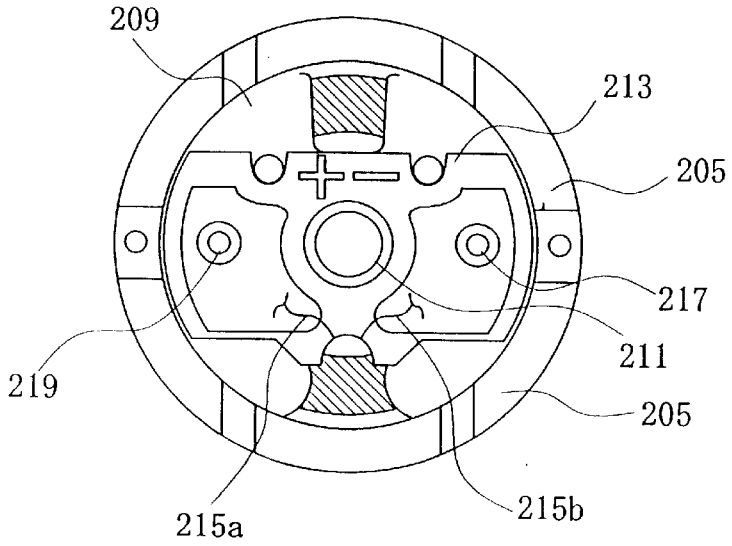
FIG. 14 (PRIOR ART)
FIG. 14 is a view of the prior art as viewed from an arrow XIV—XIV in FIG. 13.

A sixth embodiment of the present invention will be described with reference to FIG. 12. In the sixth embodiment, there is provided still another shape of the pole piece 12. Namely, there is a hole 47 in the core 11. Accordingly, the gross area of application of the layer of the magnetic material 35 is enlarged, thus the area of the magnetic path is also enlarged, thereby the efficiency of magnetic force may improve, and the equivalent efficiency of magnetic force may be obtained by thinner application of the layer of the magnetic material 35.

The present invention is not limited to the first through sixth embodiments as described above.

It is not necessary that both the diaphragm 27 and the pole piece 12 are made of resin. It is sufficient that at least the diaphragm 27 is made of resin, by which the object of the present invention can be achieved.

Further, the structure of the electroacoustic transducer is not limited to that shown in the drawings of the present invention. For example, the supporting member is not limited to the lower case 5 as above described. The diaphragm 27 may also be supported via a support ring, and the present invention may also be applied to various structures of an electroacoustic transducer which are known per se.

What is claimed is:

1. An electroacoustic transducer comprising:

a diaphragm;

a support member for supporting said diaphragm;

a pole piece placed inside said support member and comprising a core and a base;

a coil positioned around said core; and a magnet placed between said support member and said coil, wherein:

said diaphragm is made of resin, and a layer of magnetic material is provided on an outer surface of said diaphragm and/or the resin of the diaphragm and the magnetic material are mixed together, wherein said diaphragm having the layer of magnetic material on the outer surface and/or the resin mixed with the magnetic material is magnetized by said magnet; and wherein said diaphragm includes a centrally located added mass member made of resin.

2. The electroacoustic transducer as claimed in claim 1, wherein said diaphragm is in a shape to enlarge the outer surface area of said diaphragm without changing thickness of said diaphragm.

3. The electroacoustic transducer as claimed in claim 2, wherein said diaphragm has uneven surfaces to enlarge the outer surface area of said diaphragm.

4. The electroacoustic transducer as claimed in claim 3, wherein said diaphragm has at least one ring groove to enlarge the outer surface area of said diaphragm.

5. The electroacoustic transducer as claimed in claim 1, wherein the layer of the magnetic material is provided on less than all of the outer surface of said diaphragm.

6. An electroacoustic transducer as claimed in claim 1, wherein the layer of magnetic material covers all or substantially all of the outer surface of said diaphragm.

7. An electroacoustic transducer comprising:

a diaphragm;

a support member for supporting said diaphragm;

a pole piece placed inside said support member and comprising a core and a base;

a coil positioned around said core; and a magnet placed between said support member and said coil wherein:

said diaphragm is made of resin, and a layer of magnetic material is provided on an outer surface of said diaphragm and/or the resin of the diaphragm and the magnetic material are mixed together, wherein said diaphragm having the layer of magnetic material on the outer surface and/or the resin mixed with the magnetic material is magnetized by said magnet; and wherein said support member is made of resin, and said pole piece is made of resin, another layer of the magnetic material being provided on an outer surface of said pole piece and/or the resin of the pole piece and the magnetic material being mixed together.

8. The electroacoustic transducer as claimed in any one of claims 1 to claim 6, wherein said resin is an engineering plastic material.

9. An electroacoustic transducer comprising:

a diaphragm;

a support member for supporting said diaphragm;

a pole piece placed inside said support member and comprising a core and a base;

a coil positioned said core; and a magnet placed between said support member and said coil, wherein:

said diaphragm is made of resin, and a layer of magnetic material is provided on an outer surface of said diaphragm and/or the resin of the diaphragm and the magnetic material are mixed together, wherein said diaphragm having the layer of magnetic material on the outer surface and/or the resin mixed with the magnetic material is magnetized by said magnet; and wherein said layer is one of a plated layer, laminated foils, and a coating of paste of the magnetic material, and wherein the magnetic material mixed with the resin of said diaphragm is a magnetic powder.

10. The electroacoustic transducer as claimed in claim 9, wherein the magnetic material is Ni—Fe alloy.

11. The electroacoustic transducer as claimed in claim 10, wherein a ratio of said Ni—Fe alloy corresponds to 75%–25%.

12. An electroacoustic transducer comprising:

a diaphragm;

a support member for supporting said diaphragm;

a pole piece placed inside said support member and comprising a core and a base;

a coil positioned around said core; and a magnet placed between said support member and said coil, wherein:

said diaphragm is made of resin mixed together with a magnetic material, wherein said diaphragm having the resin mixed with the magnetic material is magnetized by said magnet.

13. An electroacoustic transducer comprising:

a diaphragm;

a pole piece comprising a core and a base, said core being spaced a predetermined distance form said diaphragm;

a coil positioned around said core; and a magnet surrounding said coil, wherein:

said diaphragm is made of resin and a layer of magnetic material is provided on an outer surface of said diaphragm and/or the resin of the diaphragm and the magnetic material are mixed together, wherein said diaphragm having the layer of magnetic material on the outer surface and/or the resin mixed with the magnetic material is magnetized by said magnet; and wherein said diaphragm includes a centrally located added mass member made of resin.

14. An electroacoustic transducer comprising:

a diaphragm;

a support member for supporting said diaphragm;

a pole piece placed inside said support member and comprising a core and a base;

a coil positioned said core; and a magnet placed between said support member and said coil, wherein:

said diaphragm is made of resin, and a layer of magnetic material is provided on an outer surface of said diaphragm and/or the resin of the diaphragm and the magnetic material are mixed together, wherein said diaphragm having the layer of magnetic material on the outer surface and/or the resin mixed with the magnetic material is magnetized by said magnet;

wherein said support member is made of resin, and said pole piece is made of resin another layer of the magnetic material being provided on an outer surface of said pole piece and/or the resin of the pole piece and the magnetic material being mixed together; and wherein said layer and said another layer are one of a plated layer, laminated foils, and a coating of paste of the magnetic material, and wherein the magnetic material mixed with the resin of said diaphragm and the resin of said pole piece is a magnetic powder.

* * * * *